United States Patent [19]

Feldkämper

[11] 4,370,787

[45] Feb. 1, 1983

[54] APPARATUS FOR SECURING TO FORMAT CYLINDERS FORMAT PLATES FOR THE ACCURATE TRANSFER OF APPLICATIONS OF ADHESIVE

[75] Inventor: Richard Feldkämper, Lengerich, Fed. Rep. of Germany

[73] Assignee: Windmoller & Holscher, Lengerich, Fed. Rep. of Germany

[21] Appl. No.: 211,672

[22] Filed: Dec. 1, 1980

[30] Foreign Application Priority Data

Dec. 4, 1979 [DE] Fed. Rep. of Germany ..... 2948744

[51] Int. Cl.[3] ..... B21B 27/00; B41F 27/10

[52] U.S. Cl. ..... 29/124; 29/118; 101/378

[58] Field of Search ..... 29/110, 117, 118, 124, 29/125, 129.5, 130; 241/294, 295; 101/378

[56] References Cited

U.S. PATENT DOCUMENTS 3,090,105 5/1963 Gibbar et al. ..... 29/124

FOREIGN PATENT DOCUMENTS 893343 10/1953 Fed. Rep. of Germany .

1900872 2/1963 Fed. Rep. of Germany .

*Primary Examiner*—Neil Abrams

*Attorney, Agent, or Firm*—Fleit & Jacobson

[57] ABSTRACT

In a cylinder with replaceable shaped plates for applying a predetermined pattern of adhesive to webs of material, the cylindrical surface has at least two axially spaced recesses each containing a rocker arm pivoted about an axial shaft, one end of the arm carrying a gripper engaging over one margin of a pattern plate and its other end carrying a quick-release screw clamp for the opposite pattern plate margin.

6 Claims, 3 Drawing Figures

APPARATUS FOR SECURING TO FORMAT CYLINDERS FORMAT PLATES FOR THE ACCURATE TRANSFER OF APPLICATIONS OF ADHESIVE

The invention relates to an apparatus for securing to format cylinders format plates for the accurate transfer of the format of applications of adhesive to paper or plastics webs thereon.

To transfer applications of adhesive from so-called ductor rollers onto paper or plastics webs, provision is made for format cylinders which are equipped with pattern plates having raised portions which correspond to the configuration of the adhesive applications and which take the adhesive from the ductor rollers and accurately transpose them onto the webs. In practice, it is usual to secure the format plates to the format cylinder by means of screws, the surface of the format cylinder being conventionally defined by spaced rings secured to the format cylinder shaft. When replacing the format plates, it is therefore necessary to loosen all the screws and tighten them again when securing the new format plate. This is a cumbersome and time-consuming procedure.

It is the problem of the invention to provide an apparatus for securing format plates to format cylinders that permits rapid and simple replacement of the format plates.

According to the invention, this problem is solved in an apparatus of the aforementioned kind in that the surface of the format cylinder is provided with at least two axially spaced recesses of a circumferential length larger than the circumferential width of the format plate, that a two-armed lever pivotably mounted in rocker-like manner about an axially extending shaft in the central region of the recess has one end connected to a gripper engaging over an axially extending longitudinal edge of the format plate and its other end provided with a tapped hole receiving a headed clamping screw, and that the shank of the clamping screw passes through a hole in a clamping member supported by one side on the other longitudinal edge of the format plate and by the opposite side on the edge of the recess. To remove the format plate, it is merely necessary to loosen the clamping screws until the format plate can be withdrawn. Similarly, a new format plate can be clamped into position on the format cylinder by simply inserting it and retightening the clamping screws. To release and secure the format plates, it is therefore no longer necessary to remove two rows of screws and reinsert them but it is generally sufficient to loosen and retighten only the clamping screws disposed on one side because the clamping forces are transmitted to the other side of the format plate by way of the two-armed lever.

Desirably, the width of the clamping members is less than twice the spacing of the centre line of the clamping screw from the adjacent edge of the format plate so that, after loosening the clamping screw, the format plate is released from the clamping member simply by turning the latter through about 90°.

To support the format plates at the regions opposite to the edges over which the grippers and clamping members engage, ledges may be provided to bridge the recesses. These ledges take up the clamping forces exerted by the grippers and clamping members so that the format plates can be clamped tight without twisting because no torque is exerted thereon.

In a further embodiment of the invention, the grippers are guided in radial bores of the format cylinder and provided with a groove in which one arm of the two-armed lever positively engages through a window in the wall between the bore and the recess. This construction permits easy manufacture and installation of the two-armed lever.

Additional advantageous embodiments of the invention have been described in the subsidiary claims.

One example of the invention will now be described in more detail with reference to the drawing, wherein.

Figure 1:
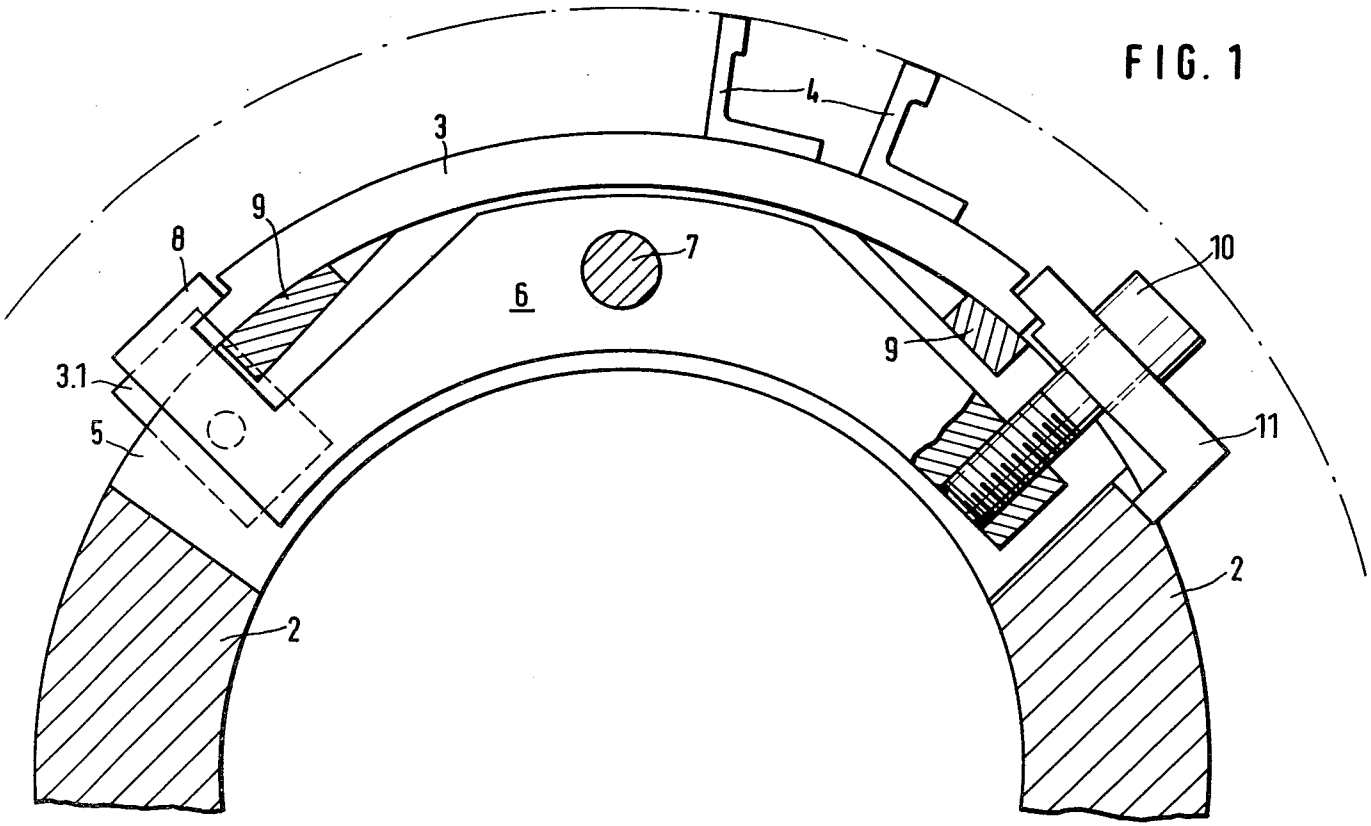
FIG. 1 is a cross-section through the format cylinder provided with clamping means for the format plate.
Figure 2:
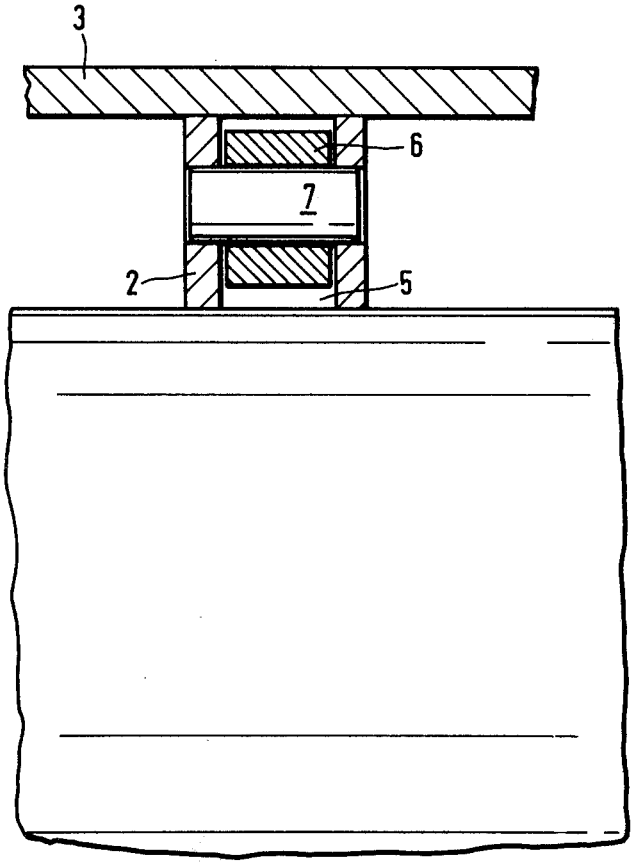
FIG. 2 is an axial section through the FIG. 1 apparatus.

Rings 2 are seated at uniform axial spacings on the shaft 1 of the format cylinder and on their surface there is a format plate 3 which is held thereto by the clamping apparatus of the invention. The format plate 3 is equipped with angle irons 4 from which adhesive is taken by a ductor roller (not shown) and transferred to a workpiece in known manner.

The rings 2 comprise milled recesses 5 in which two-armed levers 6 are loosely rotatably mounted on pins 7. One lever arm of the two-armed lever 6 is in the form of a clamping gripper 8 with which it presses the format plate 3 onto the ledge 9 formed in the ring. The other lever arm is provided with a screwthread receiving a clamping screw 10 which passes through a clamping claw 11 supported on one side on the format plate 3 and on the other side on the ring 2. The format plate 3 is additionally supported on the side of the clamping screw 10 or clamping claw 11 by a web 9 which is secured in the ring 2 and which bridges the width of the milled recess 5 in the ring 2.

By turning the clamping screw 10, the clamping claw 11 and the clamping gripper 8 are pressed onto the format plate 3 and thereby tightened. For simple removal of the format plate 3 when the latter is to be exchanged, the width of the clamping claw 11 is preferably selected to be so narrow that the claw 11 can be turned through 90° after loosening the screw 10 and the format plate 3 can then be withdrawn.

Figure 3:
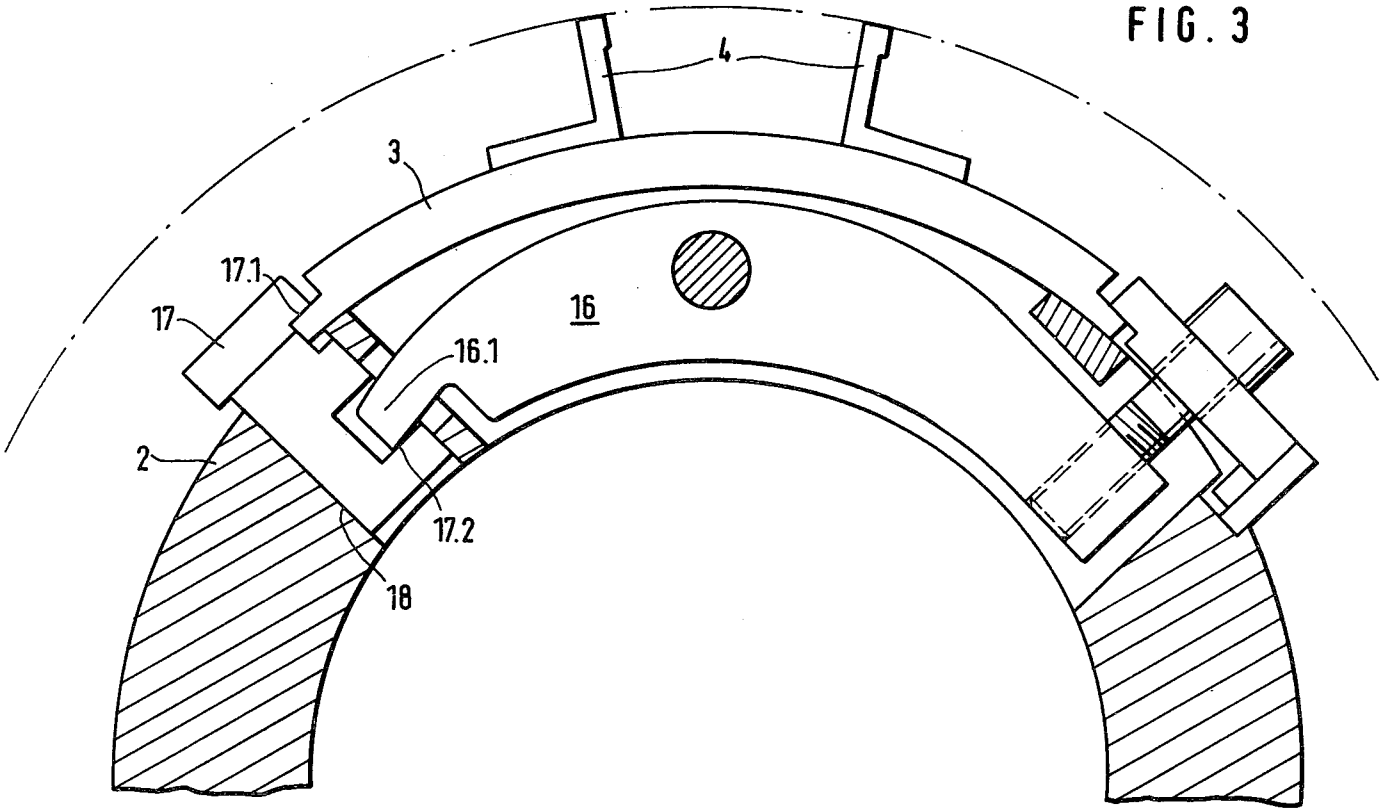
FIG. 3 is a view of the apparatus corresponding to FIG. 1 with a different embodiment of the clamping means.

The variation illustrated in FIG. 3 illustrates a two-armed lever 16 which does not have the clamping gripper formed on it. The end 16.1 of the two-armed lever 16 engages in a rotary member 17 which is inserted in a bore 18 of the ring 2. In the rotary member 17 there are two grooves 17.1 and 17.2 extending perpendicular to the axis of rotation. The format plate 3 is clamped to the ring 2 by means of the groove 17.1. The end 16.1 engages in the groove 17.2. By means of this construction, the two-armed lever 16 is easier to make and install than is the two-armed lever 6.

In the FIG. 1 embodiment, the format plate 3 strikes the abutment 3.1 so that it is blocked in the circumferential direction. The abutment 3.1 is laterally secured to the ring 2.

In the FIG. 3 embodiment, the pattern plate 3 abuts the rotary member 17 to lock it circumferentially.

I claim:

1. Apparatus for securing a format plate to a format cylinder comprising:

a format cylinder having a peripheral surface thereof provided with two axially spaced recesses having circumferential lengths greater than the circumferential width of a format plate to be secured to said cylinder;

a two-armed lever positioned in each said recess and having first and second ends;

means for pivotally mounting said levers in said recesses for pivotable movement about central portions of the levers;

gripper means positioned at the first ends of said levers for engaging and securing a first axially extending longitudinal edge of the format plate;

clamping means for clamping and securing a second axially extending longitudinal edge of the format plate, said clamping means having first portions supported by the format cylinder, second portions engaging the format plate, and holes passing therethrough, tapped holes being formed in the second ends of said levers; and clamping screws having shanks passing through said holes of said clamping means and threaded ends engaged in said tapped holes of said second lever ends whereby rotation of said clamping screws urges said clamping means and said gripper means into clamping engagement with the format plate.

2. Apparatus according to claim 1, wherein said cylinder has ledges bridging said recesses and supporting portions of the format plate at zones opposite the portions of the format plate engaged by said clamping means and said gripper means.

3. Apparatus according to claim 1 or 2, wherein said gripper means and said lever are made as one piece.

4. Apparatus according to claim 1 or 2, wherein radially extending bores are formed in said format cylinder, said gripper means comprising a gripper guided for movement in said bore and having a first groove engaged by said first lever end and a portion engageable with the format plate, said gripper being moved with respect to said bore by movement of said first lever end.

5. Apparatus according to claim 1 or 2, wherein said clamping means comprises clamping members having widths less than twice the spacings of the center lines of the clamping screws from the adjacent edge of the format plate.

6. Apparatus according to claim 1 or 2, wherein said format cylinder has a shaft and rings secured at intervals to said shaft, said recesses being formed in surfaces of said rings.

* * * * *